US008985645B2

(12) United States Patent
McConnell

(10) Patent No.: US 8,985,645 B2
(45) Date of Patent: Mar. 24, 2015

(54) SYSTEMS AND METHODS OF PROVIDING FOOT OPERATED LATCHING

(76) Inventor: Janet McConnell, Gay, GA (US)

( * ) Notice: Subject to any disclaimer, the term of this patent is extended or adjusted under 35 U.S.C. 154(b) by 117 days.

(21) Appl. No.: 13/638,582

(22) PCT Filed: Mar. 29, 2011

(86) PCT No.: PCT/US2011/030406

§ 371 (c)(1),
(2), (4) Date: Sep. 28, 2012

(87) PCT Pub. No.: WO2011/123478

PCT Pub. Date: Oct. 6, 2011

(65) Prior Publication Data

US 2013/0020814 A1 Jan. 24, 2013

Related U.S. Application Data

(60) Provisional application No. 61/318,401, filed on Mar. 29, 2010.

(51) Int. Cl.

| | |
|---|---|
| ***E05C 3/02*** | (2006.01) |
| ***E05B 53/00*** | (2006.01) |
| ***E05C 3/04*** | (2006.01) |
| *E05B 15/00* | (2006.01) |

(52) U.S. Cl.

CPC ..... *E05B 53/001* (2013.01); *E05C 3/02* (2013.01); *E05C 3/041* (2013.01); *E05B 15/0073* (2013.01)

USPC ..... 292/194; 292/108

(58) Field of Classification Search

USPC ..... 292/194, 108, 153, 255; 49/215, 274

See application file for complete search history.

(56) References Cited

U.S. PATENT DOCUMENTS

| | | | | |
|---|---|---|---|---|
| 1,594,818 | A * | 8/1926 | Daulton | 292/238 |
| 1,802,639 | A * | 4/1931 | Estey et al. | 292/202 |

FOREIGN PATENT DOCUMENTS

| | | |
|---|---|---|
| WO | 2011/123478 | 10/2011 |

* cited by examiner

*Primary Examiner* — Mark Williams

(74) *Attorney, Agent, or Firm* — Benjamin A. Balser; Balser & Grell IP Law, L.L.P.

(57) ABSTRACT

It would be beneficial to have a means for securing a door or portal, or for opening a door or portal such that it cannot be opened from the other side, in which the securing means could be operated without the use of the person's hands. Latching system 250 comprises latching device 255 and receiving device 265. Latching device 255 may be movably attached to door 220, preferably at the bottom of door 220 and latching device 255 is used to secure door 220 to door frame member 205. Latching system 250 is located substantially near the bottom of door 220 so that it may be operated by means of a person's foot. Receiving device 265 is affixed to door frame member 205. Receiving device 265 is configured to receive latching device 255 when latching device 255 is rotated towards receiving device 265.

20 Claims, 7 Drawing Sheets

PRIOR ART

SYSTEMS AND METHODS OF PROVIDING FOOT OPERATED LATCHING

CROSS-REFERENCE TO RELATED APPLICATION

This application claims benefit to U.S. provisional patent application Ser. No. 61/318,401, filed on Mar. 29, 2010, which is incorporated by reference herein.

TECHNICAL FIELD

The present disclosure is generally related to latching devices and, more particularly, is related to a foot operated latch.

BACKGROUND

Run away viruses have become troublesome in recent years. Especially in the winter months, a slew of sicknesses can debilitate people, causing lost days of work, lost wages, and other medical bills. Often, colder temperatures and stress from the holiday season aid individuals in developing a weaker immune system. When colds and the flu start coming around, it can be almost impossible to avoid being affected by them.

Some of the illnesses that people come down with are not contagious, but those that are can wreak havoc. Often, it is difficult for those sharing the same household or workplace to bypass spreading germs and bacteria that cause these sicknesses. Sanitation and cleanliness are two things that will offer defense against illness.

One should always be sure to wash their hands frequently and keep them away from their mouths, but this is especially important when sickness is going around. Washing of hands with soap and warm water frequently throughout the day is highly advisable. When family members at home are sick, it is advisable to disinfect common areas like the kitchen, bathrooms, and living room. Doing so may save others from coming down with the illness, as well. The closer that attention is paid to cleanliness and keeping things sanitary, the easier it should be to avoid the spread of bacteria. Though this will most definitely guard family members around the home, sometimes it is not enough. One particularly susceptible location for the spreading of germs is a public lavatory. A user can wash her hands before and after using the public facilities, but she must still use the hand operated latching system to secure the door to the stall she is using. This leads to a difficult situation when trying to remain safe from catching germs from a previous user. There are, thus, heretofore unaddressed needs with previous solutions.

SUMMARY

Example embodiments of the present disclosure provide systems of providing foot operated latching. Briefly described, in architecture, one example embodiment of the system, among others, can be implemented as follows: a latching device configured to be actuated by a foot of a user, the latching device affixed to one of a door and a door frame member; and a receiving device affixed to the other of the door and the door frame member, the receiving device configured to receive the latching device to secure the door in a closed position.

Embodiments of the present disclosure can also be viewed as providing methods for providing foot operated latching. In this regard, one embodiment of such a method, among others, can be broadly summarized by the following steps: providing a latching device configured to be actuated by a foot of a user, the latching device affixed to one of a door and a door frame member; and providing a receiving device affixed to the other of the door and the door frame member, the receiving device configured to receive the latching device to secure the door in a closed position.

DETAILED DESCRIPTION

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

There are many instances in which manually securing a door to be closed is difficult, or undesirable. If a user has her hands full and needs to secure a door behind them, or open a secured door to go through, it would be beneficial to have a means for securing a door or portal, or for opening a door or portal such that it cannot be opened from the other side, in which the securing means could be operated without the use of the person's hands. The securing means is intended to replace, for example, existing hand operated public restroom stall door latches and can be retro-fitted to existing stalls.

Example embodiments will be described in terms of a public restroom stall, but are applicable to other latching applications as well. The securing means could also be used in addition to existing hand operated latches, providing a sanitary option for securing doors. The use of the disclosed latching device may be used in conjunction with an existing door stop. This disclosure presents systems and methods of securing a door or other portal closing device without the user using his hands to manually secure the door in a fixed position. In some applications, the systems and methods disclosed herein may be implemented to keep a door in an open position.

Figure 1:
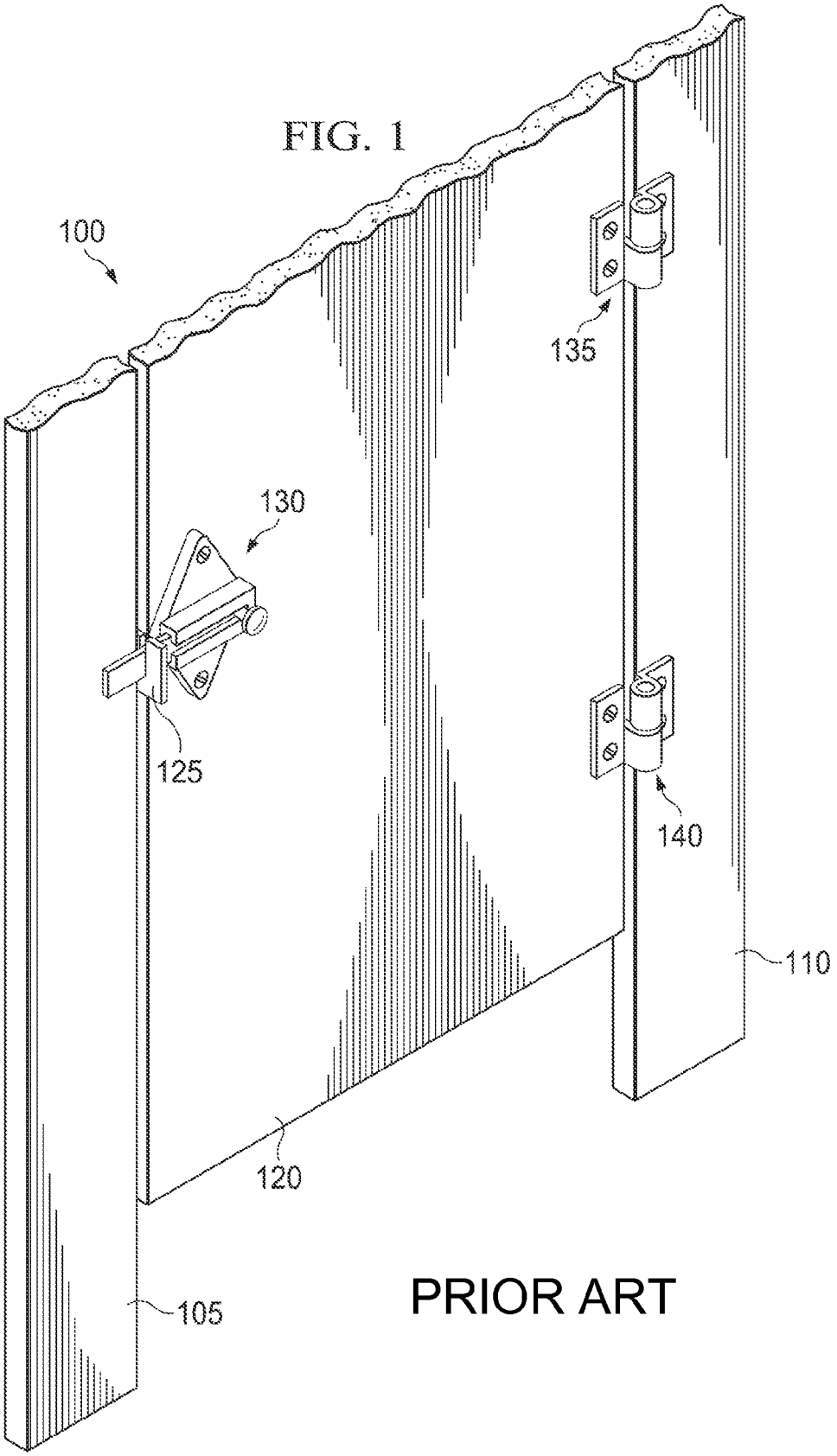
FIG. 1 is a perspective diagram of a door latch system.

FIG. 1 provides a diagram of public restroom stall 100 with latching device 130 as presently known. Latching device 130 is affixed to door 120, and receiving device 125 is affixed to door frame member 105. Door 120 is affixed to door frame member 110 with hinges 135 and 140. To secure 120 to door frame member 105, latch 130 is engaged into receiving device 125. Latch 130 is operated by a user grabbing latch 130 with her hands and sliding it over. This opens susceptibility to the spread of germs that have been left on latch 130 by another user.

Figure 2:
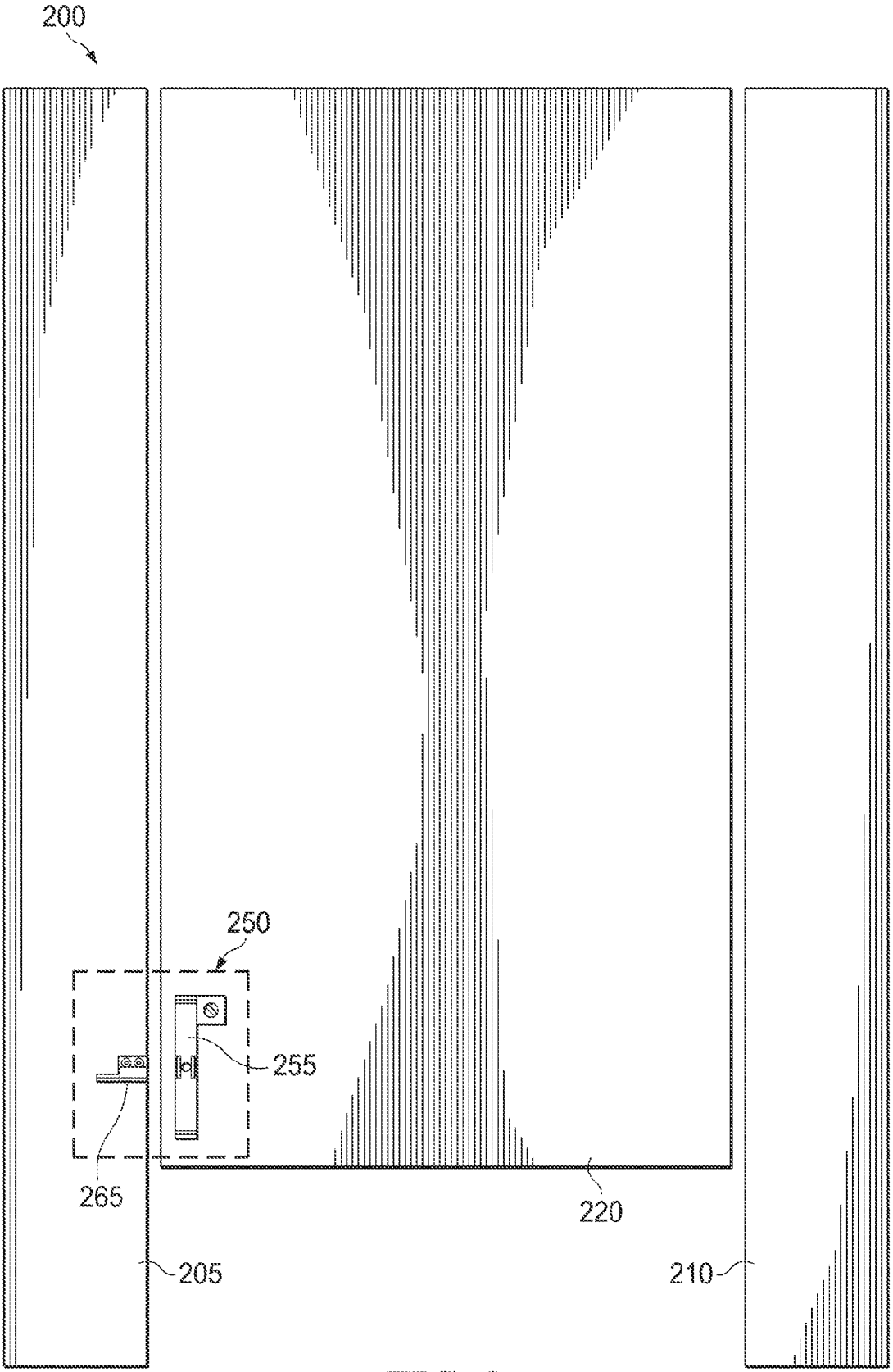
FIG. 2 is a perspective diagram of an example embodiment of a system of providing foot operated latching.

FIG. 2 provides a perspective diagram of systems and methods of providing foot operated latching as disclosed herein. In one example embodiment, system 200 comprises latching system 250, which comprises latching device 255 and receiving device 265. Latching device 255 may be movably attached to door 220, preferably at the bottom of door 220 and latching device 255 is used to secure door 220 to door frame member 205. Latching system 250 is located substantially near the bottom of door 220 so that it may be operated by means of a person's foot. Receiving device 265 is affixed to door frame member 205. Receiving device 265 is configured to receive latching device 255 when latching device 255 is rotated towards receiving device 265.

In one example embodiment, receiving device 265 is a u-shaped bracket and latching device 255 is configured to fit into the u-shaped receiving bracket of receiving device 265. The bracket may be any shape which may receive the latching device. Receiving device 265 may secure latching device 255 such that when latching device 255 is received within receiving device 265, the door is prevented from being pushed open.

In an example embodiment, latching device 255 extends in opposite directions from a center pivot point. If receiving device 265 receives latching device 255 from above receiving device 265, a user may use a foot on the section of latching device 255 that extends downward from the pivot point to rotate latching device 255 around the pivot point and into receiving device 265.

In an example embodiment, receiving device 265 may be magnetized in any manner, and latching device 255 may be of a metal which reacts to the magnetization of receiving device 265. Alternatively, latching device 255 may be magnetized and receiving device 265 may be constructed of a metal which reacts to the magnetization. In yet another example embodiment, both latching device 255 and receiving device 265 may be magnetized in opposite polarities to attract each other and hold latching device 255 in receiving device 265. In other alternative embodiments, non-magnetic means are used to secure latching device 255 in the open and/or closed positions.

Alternatively, a weight may be added to one side of latching device 255 forcing latching device 255 to return to the open position eliminating the magnet on door 220 that holds latching device 255 open. In another example embodiment, latching device 255 may be installed to door 220 off center, forcing latching device 255 into the open position thereby eliminating the magnet on door 220 that holds latching device 255 open. A spring clip may be used on door frame member 205 instead of the magnet/bracket. The spring clip would trap latching device 255 eliminating the need for magnets.

In an example embodiment, latching device 255 may be attached to the door with hardware and a pivot mechanism that will allow latching device 255 to be moved to and from a vertical or open position and a horizontal or closed position. Latching device 255 may include a pin which fits through a hole in door 220. Latching device 255 may pivot around the attached pin. The pin may fit inside a hole in door 220, or in a sleeve that fits in the hole. By moving latch device 255 to the horizontal position, latching device 255 will mate with receiving device 265 to secure door 220 to door frame member 205. Alternatively, the latching device may be attached to the door frame member and the receiving device may be attached to the door.

In an example embodiment, the latching mechanism may be attached to the door (or the door frame member) at substantially the end of the latching mechanism. This would afford a single area of the latching device to apply pressure to rotate it between the open and closed positions. In this embodiment, it is preferable for the latching device to extend past the receiving device when the latching device is in the closed position, within the receiving device. This will enable a person to access the end of the latching device to move it into the vertical or open position.

Alternatively, the pivot may be substantially away from the end of latching device 255, such that there are two areas of latching device 255 upon which to apply pressure to rotate latching device 255 between the open and closed positions. In this embodiment, latching device 255 may extend past receiving device 265; but latching device 255 may also be designed such that the end of latching device 255 fits inside receiving device 265. In this embodiment, to move latching device 255 into the closed position, pressure may be applied to a first end of latching device 255. To move latching device 255 into the open position, pressure is applied to the same first end of latching device 255, but in the opposite rotational direction. Alternatively, to open and close latching device 255, pressure may be applied to opposite ends of latching device 255.

Figure 3:
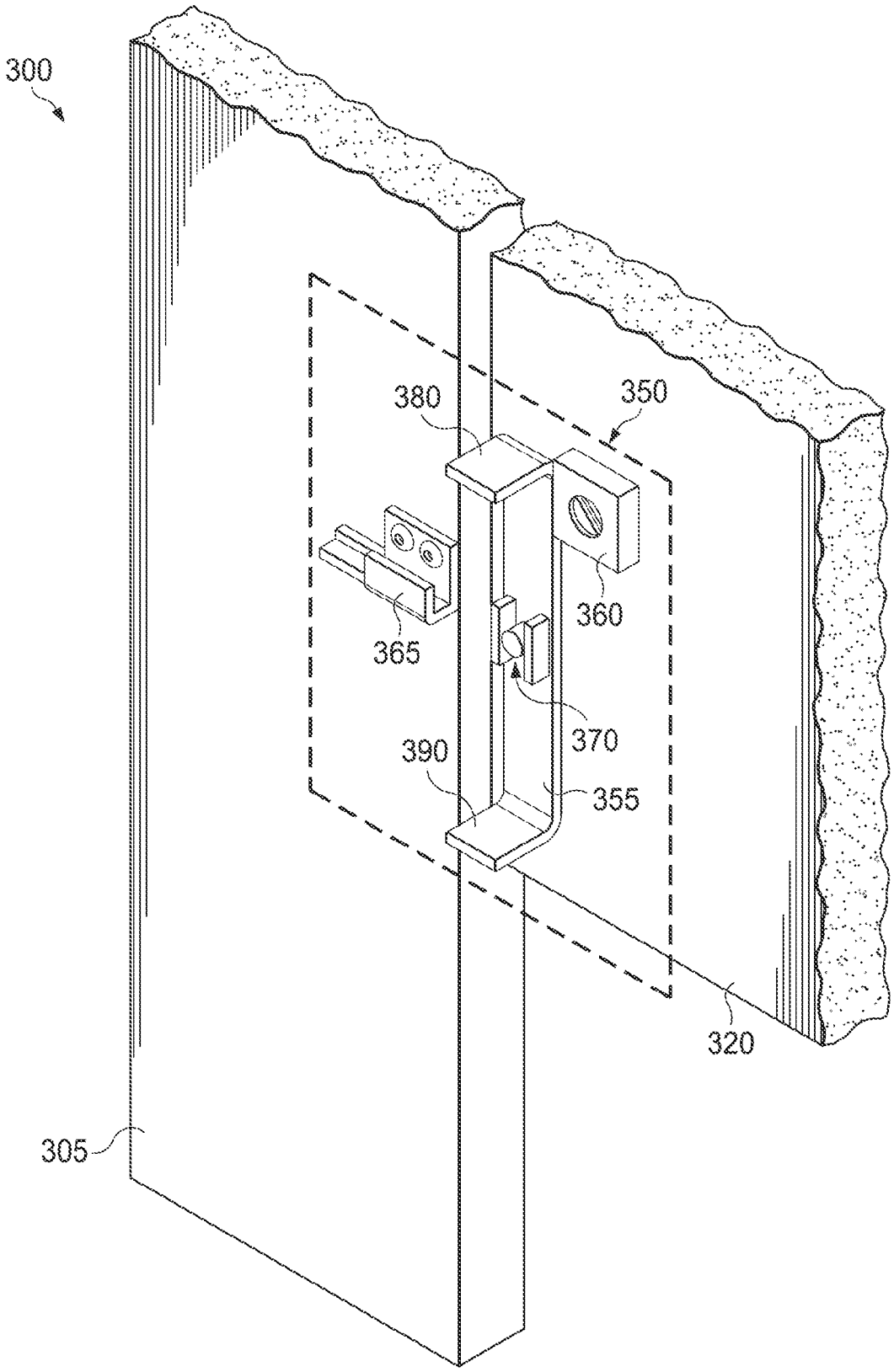
FIG. 3 is a perspective diagram of an example embodiment of the latch in the system of FIG. 2 in an disengaged position.

FIG. 3 provides a close up view of latching system 350 in an open or disengaged position. In this example embodiment, latching system 350 comprises latching device 355, pivot 370, latch stop 360, and receiving device 365. Latching device 355 rotates around pivot 370 in door 320, and fits within receiving device 365, affixed to door frame member 305, in a secured position. Latching device 355 may have one or more pedals 380, 390, which extend from latching device 355 to facilitate an easier point at which to apply pressure for a user to rotate latching device 355. Latch stop 360 is configured to stop the rotation of latching device 355 in an open position. Latch stop 360 may hold latching device 355 in a disengaged position by magnetic or some other engagement means.

An example embodiment of latching system 350 may include one or more of a steel plate with a hole, a u-bracket, magnets, screws, a sleeve, an aluminum bar with pedals, a nut, and a pin. The steel plate with the hole may be affixed to the door and or the door frame member. The steel plate may act as a support and/or guide for the sleeve and pin and/or the u-bracket. The u-bracket may be affixed to either the door or the door frame member. It may be positioned to receive the aluminum bar with the pedals. A magnet may be affixed in the u-bracket, or alternatively, the u-bracket may be fashioned out of magnetic material. The magnetic material may hold the aluminum bar in place in the u-bracket. Another magnet may also be located in the opposite structure, positioned to hold the aluminum bar in an open position. Alternatively, a magnet may be affixed at the end of the aluminum bar such that it is held in place at the metal u-bracket in a closed position, and in an open position.

The screws may be used to hold the steel plate and/or the u-bracket in place. The sleeve may be used to act as a guide for the pin. The aluminum bar may rotate about the pin, the pin being affixed from the outside of the door. The pin may have no indentations on the head of the pin such that the pin may not be rotated from outside of the door. The nut may fit on the end of the pin to secure it in place. The sleeve may extend out of the door or door frame member, such that the aluminum bar rotates around the sleeve. Alternatively, the sleeve is substantially sized to the width of the door and the bar rotates around the pin that extends from the sleeve.

Figure 4:
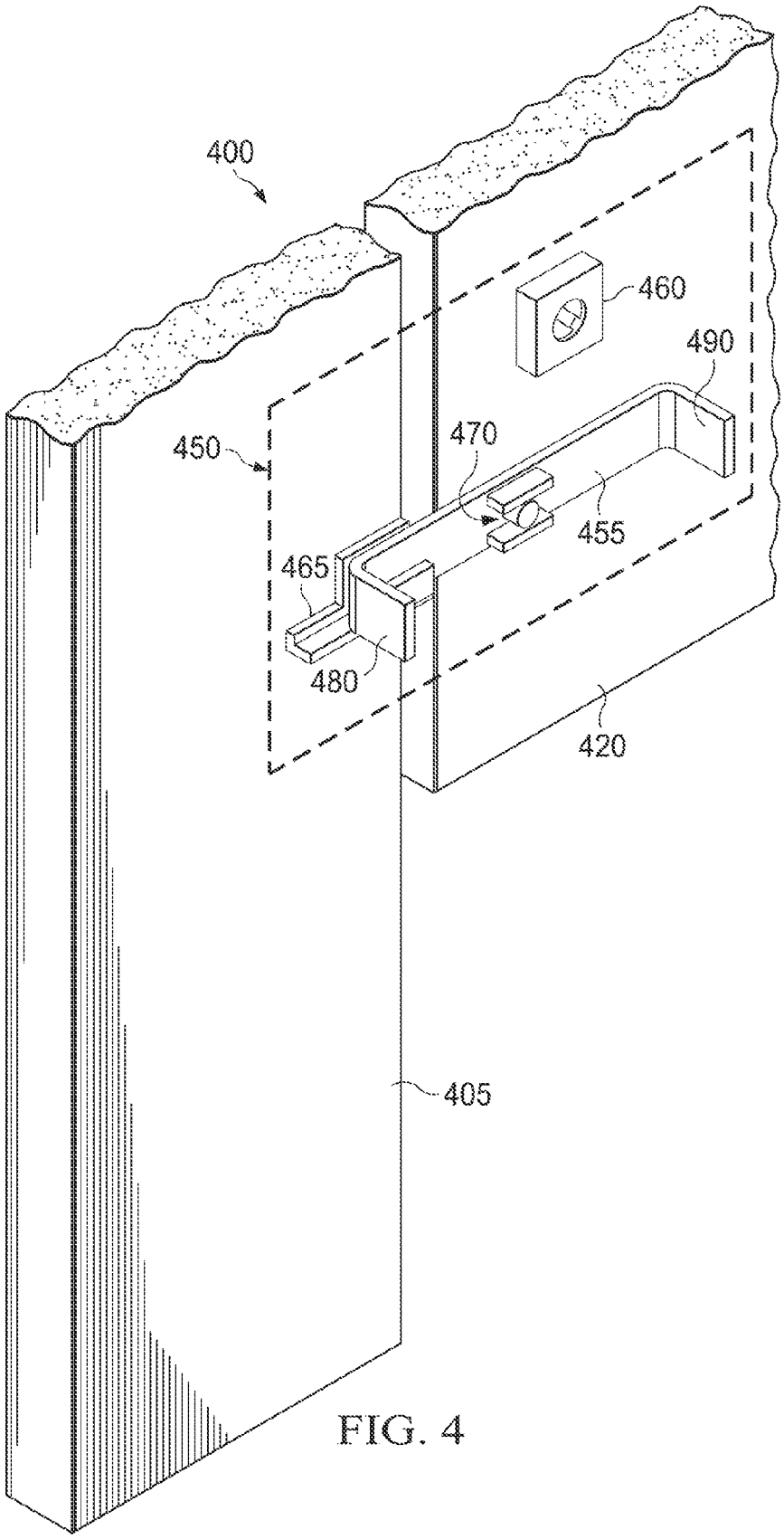
FIG. 4 is a perspective diagram of an example embodiment of the latch in the system of FIG. 2 in an engaged position.

FIG. 4 provides a close up view of latching system 450 in an engaged position. In this example embodiment, latching system 450 comprises latching device 455, pivot 470, latch stop 460, and receiving device 465. Latching device 455 rotates around pivot 470 in door 420, and fits within receiving device 465 in door frame member 405 in the secured position as shown. Latching device 455 may have one or more pedals 480, 490, which extend from latching device 455 to facilitate an easier point at which to apply pressure for a user to rotate latching device 455. As with FIG. 3, latch stop 460 of FIG. 4 is configured to stop the rotation of latching device 455 in an open position, and may be magnetized to secure latching device 455 in the open position.

Figure 5:
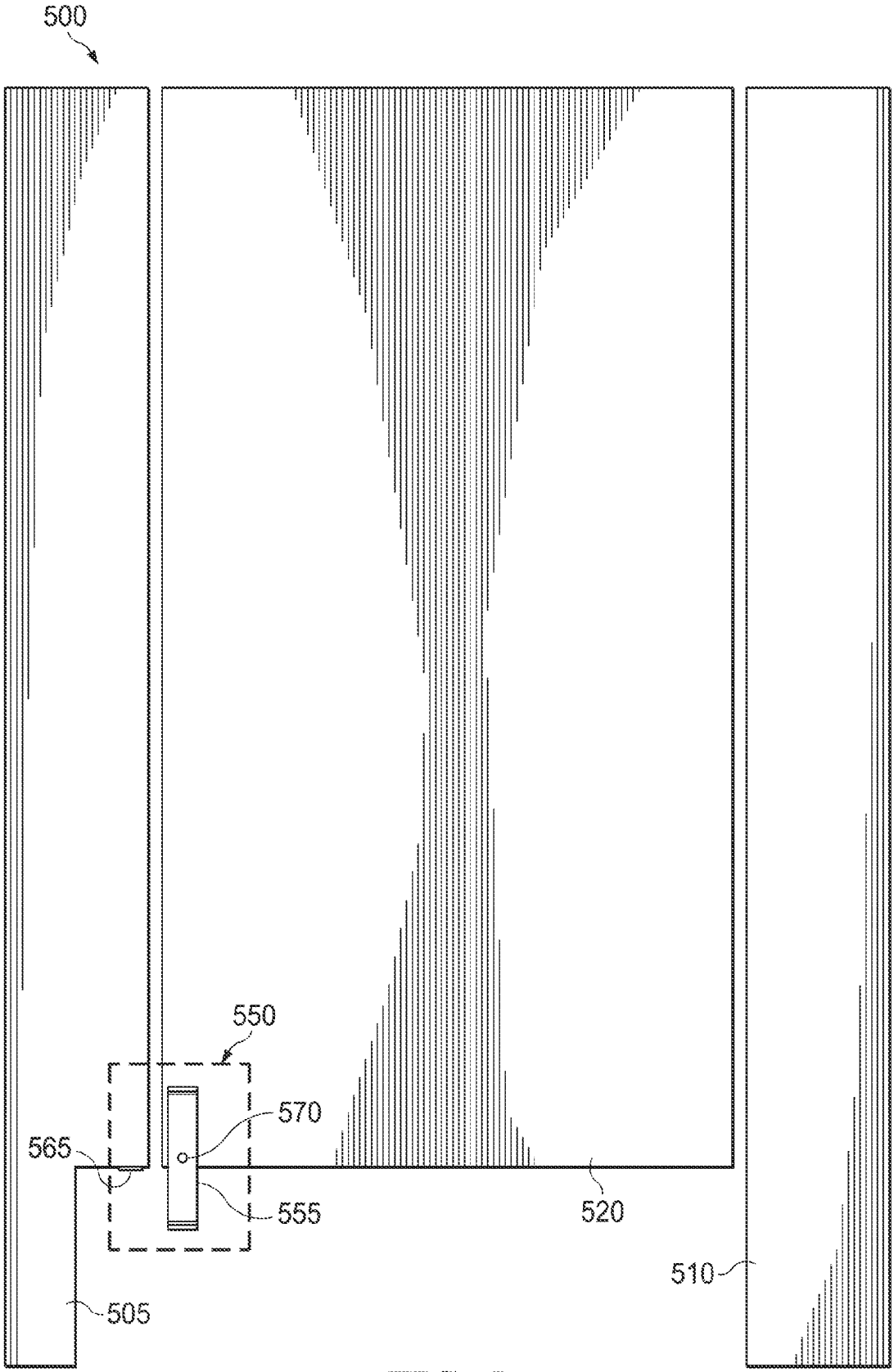
FIG. 5 is a perspective diagram of an alternative embodiment of the latch system of FIG. 2.

FIG. 5 provides a frontal view of door system 500 with latching system 550 comprising latching device 555 affixed substantially near the bottom of door 520 and strike plate 565 on door frame member 505. Door 520 swings from opposite door frame member 510. Door 520 is attached to door member 510 with hinges or some other mechanism which allows door 520 to swing from door frame member 510. Door system 500 may be for entrance to a lavatory stall in a public restroom or any other door for which it may be desirous to secure in a closed or open position, the securing performed by moving the latch by foot, ideally. Latching device 555 rotates about pivot point 570 to meet strike plate 565. One or both of latching device 555 and strike plate 565 may be magnetized. If both are magnetized, they should be magnetized in opposite polarities. In this embodiment, the latching device may extend substantially down from pivot point 570.

Figure 6:
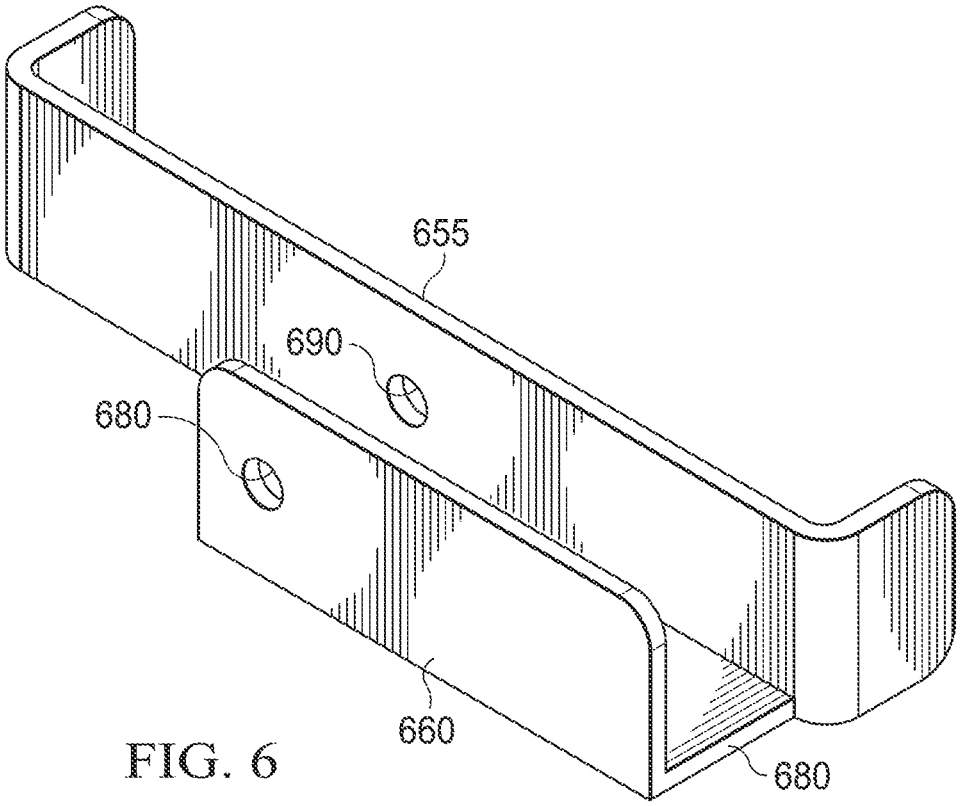
FIG. 6 is a perspective diagram of an example embodiment of the latch in the system of FIG. 5.

FIG. 6 provides a perspective view of latching device 655. In this alternative embodiment, latch device 655 rotates around a pivot point. The pivot point may be, as non-limiting examples, a pin, a screw, or a sleeve with a fastener that fits through pivot holes 680 and 690. In a restroom stall implementation, pivot hole 690 is on the inner side of the restroom stall door and pivot hole 680 is on the outer side of the restroom stall door. Bottom plate 680 meets strike plate 565 shown in FIG. 5. Outside plate 660 slides along the outside of the door and door frame, securing the door with inside plate 655 and bottom plate 680.

Figure 7:
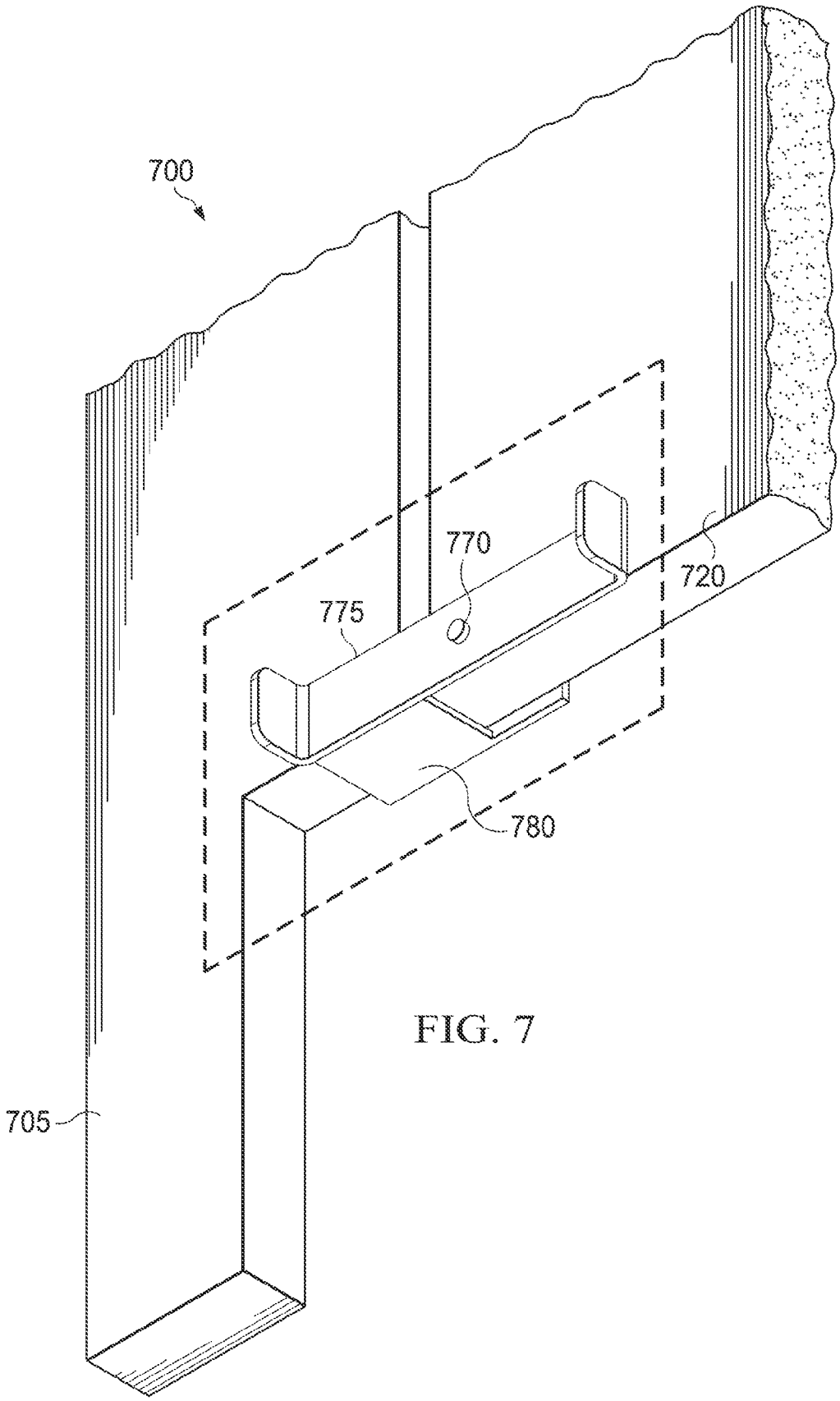
FIG. 7 is a perspective diagram of an example embodiment of the latch in the system of FIG. 5 in an engaged position.

FIG. 7 provides a bottom perspective of latching system 700. Latching inside plate 755 rotates around pivot point 770 in door 720 so that bottom plate 780 meets the strike plate on the bottom part of door frame member 705.

Figure 8:
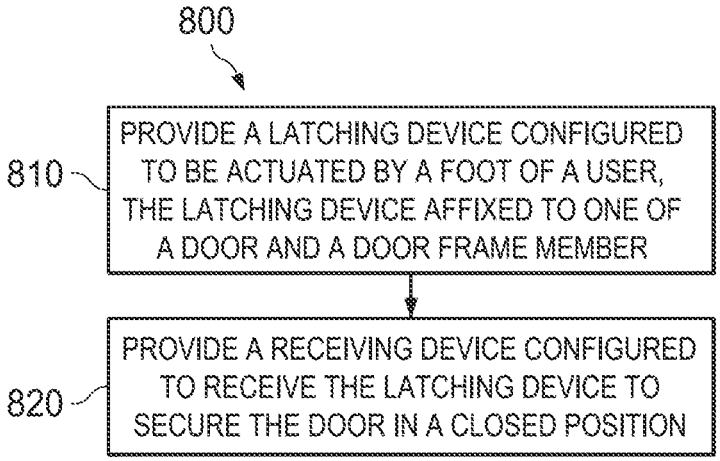
FIG. 8 is a flow diagram of an example embodiment of a method of providing a foot operated latch.

FIG. 8 provides flow diagram 800 of an example embodiment of a method of providing foot operated latching. In block 810, a latching device is provided. The latching device is configured to be foot operated and is affixed to one of a door frame and a door frame member. In block 820, a receiving device is provided. The receiving device is configured to receive the latching device to secure the door in a closed position.

In an alternative embodiment, the action of engaging or disengaging the example embodiments of the latching device may activate a vacancy indicator on the door or a door frame member. The activation of the vacancy indicator may be by electronic or mechanical means including RF, infrared, electrical wire, mechanical wire, string, rod, or other means known to one of skill in the art.

Although the systems and methods disclosed herein have been described in terms of magnetic securing and lavatory door implementations, the disclosed systems and methods may be implemented with other door, shutter, or even window systems, with other shapes and sizes of latches, and with other securing/fastening means such as stud ball fasteners, bearing fasteners, or any other fastening means known to one of ordinary skill in the art. It should be understood that various changes, substitutions and alterations can be made thereto without departing from the spirit and scope of the disclosure as defined by the appended claims.

Therefore, at least the following is claimed:

1. A combination of a device, a lavatory door, and a lavatory door frame member, the combination comprising:

a latching device configured to be actuated by a foot of a user, the latching device affixed to one of a bottom portion of the lavatory door and a bottom portion of the lavatory door frame member, the latching device further configured to be actuated for rotational motion in a plane substantially parallel to the plane of the door via the foot of the user; and a receiving device affixed to the other of the lavatory door and the lavatory door frame member, the receiving device configured to receive the latching device to secure the lavatory door in a closed position.

2. The device of claim 1, wherein the latching device is positioned up in an unsecured position.

3. The device of claim 1, wherein the latching device fits into the top if of the receiving device when the latching device is actuated into the receiving device.

4. The device of claim 1, wherein the latching device is positioned down in an unsecured position.

5. The device of claim 1, wherein the latching device fits into the bottom of the receiving device when the latching device is actuated into the receiving device.

6. The device of claim 1, wherein at least one of the latching device and the receiving device is magnetized.

7. The device of claim 1, wherein the latching device rotates around a pivot point and is substantially equal in length on both sides of the pivot point.

8. A method of providing a hands free method of securing a lavatory door, the method comprising:

providing a latching device configured to be actuated by a foot of a user, the latching device affixed to one of a bottom portion of the lavatory door and a bottom portion of a lavatory door frame member, and the latching device actuated for rotational motion in a plane substantially parallel to the plane of the door via the foot of the user; and providing a receiving device affixed to the other of the lavatory door and the lavatory door frame member, the receiving device configured to receive the latching device to secure the lavatory door in a closed position.

9. The method of claim 8, wherein the latching device fits into the top of the receiving device when the latching device is actuated into the receiving device.

10. The method of claim 8, wherein the latching device fits into the bottom of the receiving device when the latching device is actuated into the receiving device.

11. The method of claim 8, wherein at least one of the latching device and the receiving device is magnetized.

12. The method of claim 8, wherein the latching device rotates around a pivot point and is substantially equal in length on both sides of the pivot point.

13. The method of claim 11, further providing a magnetized latch stop configured to hold the latching device in a disengaged position.

14. A lavatory door system, comprising:

a door;

a door frame member;

a latching device configured to be actuated by a foot of a user, the latching device affixed to one of a bottom portion of the door and a bottom portion of the door frame member, the latching device further configured to be actuated for rotational motion in a plane substantially parallel to the plane of the door via the foot of the user; and a receiving device affixed to the other of the door and the door frame member, the receiving device configured to receive the latching device to secure the door in a closed position.

15. The lavatory door system of claim 14, wherein the latching device fits into the top of the receiving device when the latching device is actuated into the receiving device.

16. The lavatory door system of claim 14, wherein the latching device fits into the bottom of the receiving device when the latching device is actuated into the receiving device.

17. The lavatory door system of claim 14, wherein at least one of the latching device and the receiving device is magnetized.

18. The lavatory door system of claim 14, wherein the latching device rotates around a pivot point and is substantially equal in length on both side of the pivot point.

19. The system of claim 15, wherein, the receiving device is a clipping device.

20. The system of claim 15, wherein the lavatory door forms a space between a bottom end of the door and a floor and at least one end of the latching device rotates through the space between the bottom end of the door and the floor.

* * * * *